US005100078A

United States Patent [19]

Clark

[11] Patent Number: 5,100,078

[45] Date of Patent: Mar. 31, 1992

[54] METHOD AND APPARATUS FOR CONTROLLING OPTICAL FIBER PAYOUT FROM THE INSIDE OF A WOUND PACKAGE OF OPTICAL FIBER

[75] Inventor: James Clark, Gaithersburg, Md.

[73] Assignee: Optelecom, Inc., Gaithersburg, Md.

[21] Appl. No.: 698,158

[22] Filed: May 9, 1991

[51] Int. Cl.[5] ..... B65H 55/00; B65H 49/02

[52] U.S. Cl. ..... 242/171; 242/128; 242/130; 242/146; 242/159; 242/172

[58] Field of Search ..... 242/171, 170, 172, 159, 242/163, 128, 129, 129.5, 130, 132, 134, 137, 137.1, 138, 141, 146

[56] References Cited

U.S. PATENT DOCUMENTS

| | | | |
|---|---|---|---|
| 600,269 | 3/1898 | Pratt . | |
| 2,200,140 | 5/1940 | Willeke et al. | 242/128 X |
| 2,240,153 | 4/1941 | Carter et al. | 57/58 |
| 2,727,703 | 12/1955 | Bonnett | 242/128 |
| 3,272,455 | 9/1966 | Sternberg et al. | 242/171 |
| 3,746,276 | 7/1973 | Stotler | 242/171 X |
| 4,019,636 | 4/1977 | Wise | 206/396 |
| 4,274,607 | 6/1981 | Priest | 242/163 |
| 4,553,707 | 11/1985 | Henrich | 242/170 |

*Primary Examiner*—Stanley N. Gilreath

*Attorney, Agent, or Firm*—Kerkam, Stowell, Kondracki & Clarke

[57] ABSTRACT

A fiber optic bundle is wound for inside payout and is provided with a housing, with flanges, which maintains compressive force on the windings, and the payout of optical fiber is controlled by a substantially cylindrical mandrel placed in the interior of the inside payout spool. The mandrel supports a small-diameter tube through which the optical fiber pays and places drag on the optical fiber. The drag placed on the optical fiber passing through the small-diameter tube may be increased by slightly bending the tube. The combination of mandrel and small-diameter tube combine to hold the fiber coils in place and supply a certain amount of payout tension on the optical fiber.

6 Claims, 1 Drawing Sheet

METHOD AND APPARATUS FOR CONTROLLING OPTICAL FIBER PAYOUT FROM THE INSIDE OF A WOUND PACKAGE OF OPTICAL FIBER

BACKGROUND OF THE INVENTION

It is known to control payout dynamics of wound filaments wherein payout is from the inside or outside, or both inside and outside, of spool-wound filaments. Examples of such control means are disclosed in U.S. Pat. Nos. 600,269, Pratt; 2,240,153, Carter et al; 4,019,636, Wise; and 4,274,607, Priest.

BRIEF SUMMARY OF THE INVENTION

This invention relates to methods and apparatus for controlling optical fiber payout from the interior of wound, hollow, spindleless, toroidal-shaped wound packages. "Controlling payout" as used herein includes developing drag or tension on the fiber and preventing tangling as the fiber is drawn from the interior of wound packages. The apparatus generally comprises a wound, hollow, toroidal-like package of optical fiber, a casing comprising top and bottom flanges, a side wall holding the top and bottom flanges in compression against the optical fiber of the package, a circular opening in one of the flanges, a hollow, substantially cylindrical mandrel secured to the flange having the circular opening therein to project into the hollow package of optical fiber and a small-diameter tube supported within the substantially cylindrical mandrel and through which a free end of the optical fiber pays.

The invention also includes the method steps of winding a hollow, spindleless, toroidal-shaped optical fiber package; placing the optical fiber under compression parallel to the hollow axis; maintaining a hollow, substantially cylindrical mandrel within the toroidal-shaped package; supporting a small diameter tube within the hollow, substantially cylindrical mandrel; and paying out optical fiber from the inside of the package through the small-diameter tube.

DETAILED DESCRIPTION OF THE INVENTION

Figure 1:
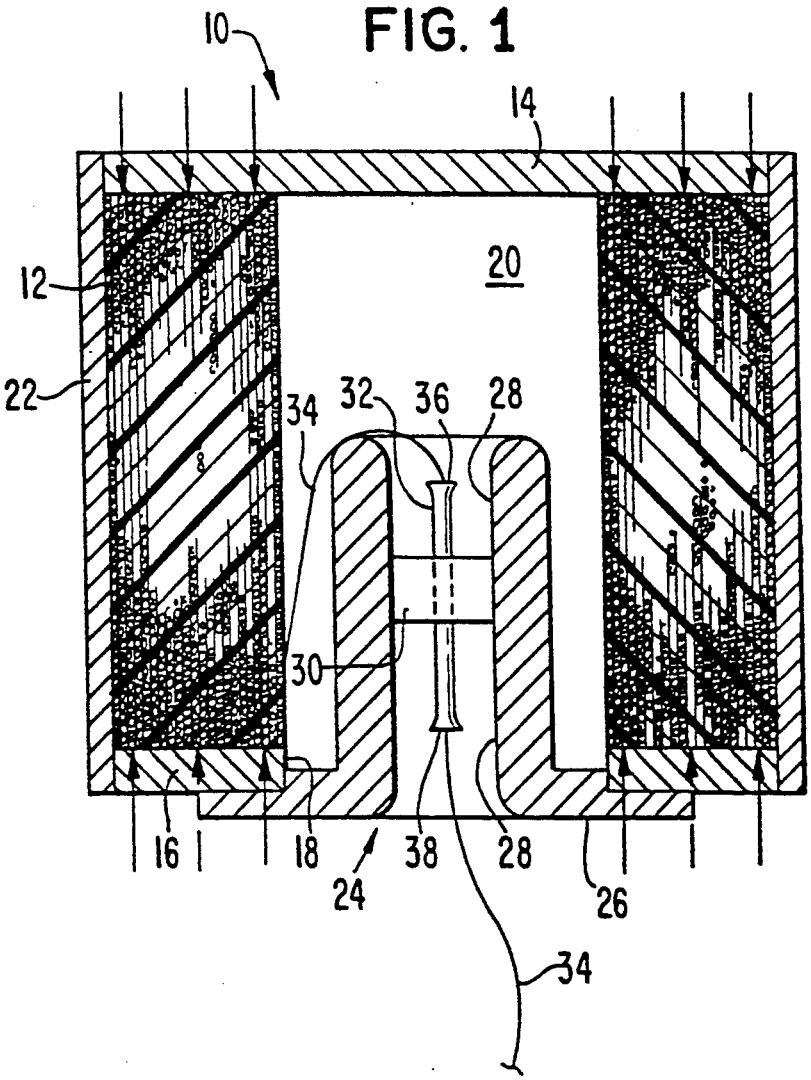
FIG. 1 is a partial, sectional view through an optical fiber package, having the features of the present invention.

Referring particularly to FIG. 1 of the drawing, 10 generally designates an optical fiber package constructed in accordance with the teachings of the present invention.

The package 10 includes a fiber optical bundle 12 wound in a generally toroidal configuration. The bundle 12 is contained in a housing consisting of a top flange 14 and a doughnut-shaped base flange 16. The base 16 has a central opening 18 therethrough and the diameter of the opening 18 is substantially equivalent to the opening 20 in the fiber optic bundle. The flanges 14 and 16 are secured together by a cylindrical side wall 22. The side wall has a length such that the optical fibers of the bundle 12 are maintained under slight compression.

Mounted within the opening 18, and partially projecting within the opening 20 in the fiber bundle, is a substantially cylindrical mandrel generally designated 24. The mandrel 24 has a flange 26 which is attached to the flange 16 forming a part of the housing for the fiber bundle. The flange 26 may be bolted, or otherwise secured, to the flange 16.

Within the opening 28 in the mandrel 24 is a spider 30 which mounts a small-diameter tube 32. The opening through the tube 32 is sized only slightly larger than the average diameter of the optical fiber 34 and its typical plastic buffer. The inlet 36 and the outlet 38 of the tube 32 may be slightly flared to reduce fiber breakage when entering and paying out through the tube. Typically, and as an example, if the opening 20 in the fiber optic package is one and one-half inches in diameter, the mandrel 24 would have an external diameter of about one inch and an interior opening diameter of about one-half inch, and the length of the mandrel is about two-thirds of the length of the opening 20 in the optical fiber package.

In FIG. 1, the optical fiber 34 is shown paying out from the interior of the bundle 12, then into the interior of the mandrel 24, through the small-diameter tube 32, thence to, for example, an optical fiber sensor, whereas the opposite end of the bundle of optical fiber (not shown) is connected to, for example, an optical receiver.

Figure 2:
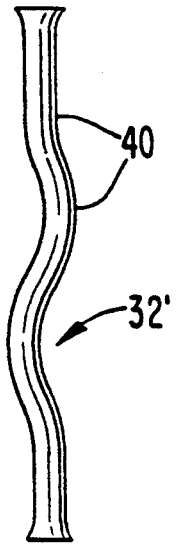
FIG. 2 shows an elevational view of a small-diameter tube modified to increase the drag on the optical fiber as it pays through the small-diameter tube.

It has been found that without the mandrel 24, (which projects into the opening 20, about one-half to three-quarters of the height of the optical fiber bundle 12) paying out of the optical fiber, the fiber would have a tendency to tangle and break. With the mandrel, the fiber cannot spring freely from the winding. Further, the mandrel induces some drag on the paying out optical fiber, and the remainder of the control drag is induced onto the fiber as the fiber passes through the small-diameter tube 32.

Where the match between the inner diameter of the tube 32 and the optical fiber 34 is not sufficient to place the desired tension on the fiber, the small-diameter tube may be slightly bent, as illustrated in FIG. 2, which bend or bends 40 induces greater drag in the optical fiber as it passes through the tube 32'.

In carrying out the invention, the major diameter of the substantially cylindrical mandrel is from about one-fourth to about three-fourths of the diameter of the opening through the toroidal-like optical fiber package, and the length of the substantially cylindrical mandrel is from about one-half to about three-fourths of the length of the opening through the toroidal-like package of optical fiber. Further, the length of the small-diameter tube would be from about one-fourth to about three-fourths the length of the mandrel.

The entire bundle or package 10 may be carried by a projectile, a traveling vehicle, or the package may be maintained at a ground station which may be a vehicle, and the end of the optical fiber 34 paying through the outlet end of the package may be carried by a traveling vehicle, projectile, or missile, and the like.

I claim:

1. Apparatus for controlling optical fiber payout from the interior of a wound, hollow spindleless, toroidal-like package of optical fiber, comprising a casing housing the optical fiber package, said casing including top and bottom flanges and a side wall holding the top and bottom flanges in compression against the fibers of the optical fiber package; a circular opening in one of the flanges, said circular opening having a diameter substantially equal to the diameter of the opening through the toroidal-like package, a hollow, substantially cylindrical mandrel secured to the said one of said flanges and projecting into the toroidal-like package, and a small-diameter tube supported within the mandrel and through which a free end of the optical fiber pays.

2. The apparatus as defined in claim 1 wherein the diameter of the small-diameter tube is such as to place drag on the optical fiber as the fiber pays therethrough.

3. The apparatus as defined in claim 2 wherein the diameter of the mandrel is less than the diameter of the opening through the toroidal-like package of wound optical fiber.

4. The apparatus as defined in claim 3 wherein the height of the mandrel is less than the height of the opening through the wound package of optical fiber.

5. A method to control payout dynamics of optical fiber, the steps: winding a spindleless, toroidal-like optical fiber package; placing the optical fiber under compression parallel to the hollow axis of the toroidal-like package; maintaining a hollow mandrel within the opening through the toroidal-like package; supporting a small-diameter tube within the hollow mandrel with axis of the tube parallel to the axis of the opening through the toroidal-like package, and paying out optical fiber from the inside of the package through the small-diameter tube.

6. The method defined in claim 5 further including sizing the opening in the small-diameter tube to place drag on the optical fiber as the fiber pays through the tube.

* * * * *